US010563376B2

(12) United States Patent
Lehtinen et al.

(10) Patent No.: US 10,563,376 B2
(45) Date of Patent: Feb. 18, 2020

(54) ARRANGEMENT FOR CONTROLLING A WORK MACHINE

(71) Applicant: SANDVIK MINING AND CONSTRUCTION OY, Tampere (FI)

(72) Inventors: Antti Lehtinen, Tampere (FI); Hannu Makela, Helsinki (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 246 days.

(21) Appl. No.: 15/518,505

(22) PCT Filed: Oct. 13, 2014

(86) PCT No.: PCT/EP2014/071871

§ 371 (c)(1),
(2) Date: Apr. 12, 2017

(87) PCT Pub. No.: WO2016/058625

PCT Pub. Date: Apr. 21, 2016

(65) Prior Publication Data

US 2017/0247860 A1 Aug. 31, 2017

(51) Int. Cl.
*G01C 22/00* (2006.01)
*E02F 9/20* (2006.01)
(Continued)

(52) U.S. Cl.
CPC ..... *E02F 9/205* (2013.01); *E02F 3/283* (2013.01); *E02F 3/434* (2013.01); *E02F 9/2029* (2013.01);
(Continued)

(58) Field of Classification Search
CPC . E02F 9/205; E02F 3/283; E02F 9/262; E02F 9/2041; E02F 9/2037; E02F 3/434;
(Continued)

(56) References Cited

U.S. PATENT DOCUMENTS 6,223,110 B1 4/2001 Rowe et al.
6,321,153 B1 * 11/2001 Rocke ..... E02F 3/434 172/4.5

(Continued)

FOREIGN PATENT DOCUMENTS

DE 19800184 A1 7/1998
DE 19731929 A1 1/1999

(Continued)

*Primary Examiner* — Khoi H Tran
*Assistant Examiner* — B M M Hannan
(74) *Attorney, Agent, or Firm* — Corinne R. Gorski

(57) ABSTRACT

A method for controlling loading material to a bucket of a work machine from a stack of material is disclosed. The method includes the steps: of selecting a control profile to be used as a basic control profile including indications for positions of at least one of the bucket and the boom of the work machine as a function of a distance traveled by the work machine with reference to a reference location; obtaining information of a distance traveled by the work machine while loading material to the bucket; examining at least one condition regarding the work machine during loading; and determining, on the basis of the examined condition, whether another position than indicated by the selected control profile is to be used for at least one of the bucket and the boom.

23 Claims, 7 Drawing Sheets

(51) Int. Cl.

| | |
|---|---|
| ***E02F 3/43*** | (2006.01) |
| ***E02F 9/26*** | (2006.01) |
| ***E02F 3/28*** | (2006.01) |
| *E02F 3/40* | (2006.01) |
| *E02F 9/22* | (2006.01) |

(52) U.S. Cl.
CPC ..... *E02F 9/2037* (2013.01); *E02F 9/2041* (2013.01); *E02F 9/262* (2013.01); *E02F 3/40* (2013.01); *E02F 9/2271* (2013.01); *E02F 9/2292* (2013.01)

(58) Field of Classification Search
CPC ..... E02F 9/2029; E02F 9/2292; E02F 9/2271; E02F 3/40
USPC ..... 701/23
See application file for complete search history.

(56) References Cited

U.S. PATENT DOCUMENTS

| | | | | |
|---|---|---|---|---|
| 6,363,632 | B1 | 4/2002 | Stentz et al. | |
| 7,555,855 | B2 | 7/2009 | Alshaer et al. | |
| 7,734,397 | B2 | 6/2010 | Peterson et al. | |
| 8,620,535 | B2 | 12/2013 | Friend et al. | |
| 9,777,465 | B2 * | 10/2017 | Paull | E02F 3/3417 |
| 2004/0117092 | A1 * | 6/2004 | Budde | E02F 3/432 701/50 |
| 2006/0245896 | A1 | 11/2006 | Alshaer et al. | |
| 2007/0260380 | A1 * | 11/2007 | Mintah | E02F 9/2029 701/50 |
| 2008/0199294 | A1 * | 8/2008 | Sahlin | E02F 3/847 414/694 |
| 2008/0234902 | A1 * | 9/2008 | Johnson | E02F 3/422 701/50 |
| 2010/0198466 | A1 * | 8/2010 | Eklund | E02F 9/26 701/50 |
| 2012/0095640 | A1 | 4/2012 | Lehtinen et al. | |
| 2012/0136508 | A1 | 5/2012 | Taylor et al. | |
| 2012/0136524 | A1 | 5/2012 | Everett et al. | |
| 2013/0006484 | A1 | 1/2013 | Avitzur et al. | |
| 2013/0073151 | A1 * | 3/2013 | Wada | E02F 3/434 701/50 |
| 2014/0207346 | A1 * | 7/2014 | Filla | E02F 3/431 701/50 |
| 2016/0017571 | A1 * | 1/2016 | Paull | E02F 9/2228 701/50 |
| 2016/0265185 | A1 * | 9/2016 | Imaizumi | E02F 3/434 |

FOREIGN PATENT DOCUMENTS

| | | | |
|---|---|---|---|
| DE | 202007006501 | U1 | 6/2008 |
| SU | 1305273 | A1 | 4/1987 |
| SU | 1565981 | A1 | 5/1990 |
| WO | 95/33896 | A1 | 12/1995 |
| WO | 2013043087 | A1 | 3/2013 |

* cited by examiner

ARRANGEMENT FOR CONTROLLING A WORK MACHINE

RELATED APPLICATION DATA

This application is a § 371 National Stage Application of PCT International Application No. PCT/EP2014/071871 filed Oct. 13, 2014.

FIELD OF THE INVENTION

The present invention relates to work machines, and more particularly to controlling loading of a bucket of a work machine.

BACKGROUND OF THE INVENTION

Various mining vehicles, such as rock drilling equipment, loading equipment and transport equipment, may be manned or unmanned. Unmanned mining vehicles may be remote-controlled by an operator from a control station, for instance, and they may be equipped with measuring instruments suitable for location determination. Unmanned mining vehicles may be operated automatically, e.g. driven along a desired route in the mine, as long as the location of the device can be determined. The automated operation may be carried out in a surface or underground operating area.

Loading equipment may be used to load and transport excavated material from one place to another, for example from a mine to out of the mine or to a loading pallet of a transport equipment. Loading of a bucket of the loading equipment may be performed e.g. so that the loading equipment is driven near a stack of excavated material such as ore, rocks or sand. The bucket may then be lowered down and also a boom to which the bucket is coupled may be lowered down, wherein the bucket is on the surface of the ground or near it. The loading equipment may now be driven forward so that the bucket contacts the stack. Driving the loading equipment may be continued with as large force as possible. If the loading equipment stops due to too high resistance of the stack of material, the bucket may be lifted upwards, which may enable driving the loading equipment a bit further. The material loaded to the bucket can then be moved to another place, for example to a spot reserved for unloading the material or in a loading pallet of transport equipment.

SUMMARY OF THE INVENTION

An improved method and technical equipment implementing the method has now been developed for improving the efficiency of loading a bucket of a work machine. Various aspects of the invention include a method, an apparatus, a work machine and a computer program product, which are characterized by what is stated in the independent claims. Various embodiments of the invention are disclosed in the dependent claims.

According to a first aspect, there is provided a method for loading material to a bucket of a work machine from a stack of material, the method comprising: selecting a control profile to be used as a basic control profile comprising indications for positions of at least one of the bucket and the boom of the work machine as a function of a distance traveled by the work machine with reference to a reference location; obtaining information of a distance traveled by the work machine while loading material to the bucket; examining at least one condition regarding the work machine during loading; determining, on the basis of the examined condition, whether another position than indicated by the selected control profile is to be used for at least one of the bucket and the boom; and if so, selecting another position.

According to a second aspect, there is provided an apparatus arranged to initiate loading of material to a bucket of a work machine from a stack of material; the apparatus being arranged to a) select a control profile to be used as a basic control profile comprising indications for positions of at least one of the bucket and the boom of the work machine as a function of a distance traveled by the work machine with reference to a reference location;
b) obtain information of a distance traveled by the work machine while loading material to the bucket;
c) examine at least one condition regarding the work machine during loading;
d) determine, on the basis of the examined condition, whether another position than indicated by the selected control profile is to be used for at least one of the bucket and the boom; and
e) select said another position, if step e) indicated that another position than indicated by the selected control profile is to be used for at least one of the bucket and the boom.

According to a third aspect, there is provided a computer program product, stored on a non-transitory memory medium, comprising computer program code for carrying out loading material to a bucket of a work machine from a stack of material, wherein the computer program code which, when executed by a processor, causes an apparatus to perform:

a) select a control profile to be used as a basic control profile comprising indications for positions of at least one of the bucket and the boom of the work machine as a function of a distance traveled by the work machine with reference to a reference location;
b) obtain information of a distance traveled by the work machine while loading material to the bucket;
c) examine at least one condition regarding the work machine during loading;
d) determine, on the basis of the examined condition, whether another position than indicated by the selected control profile is to be used for at least one of the bucket and the boom; and
e) select said another position, if step e) indicated that another position than indicated by the selected control profile is to be used for at least one of the bucket and the boom.

According to a fourth aspect, there is provided a remotely operable work machine comprising a bucket attached with a boom for loading material to the bucket from a stack of material, wherein the work machine comprises a control profile to be used as a basic control profile comprising indications for positions of at least one of the bucket and the boom of the work machine as a function of a distance traveled by the work machine with reference to a reference location;
equipment for obtaining information of a distance traveled by the work machine while loading material to the bucket;
condition monitoring equipment for monitoring at least one condition regarding the work machine;
a control unit adapted to:
examine at least one condition regarding the work machine during loading;
determine, on the basis of the examined condition, whether another position than indicated by the selected control profile is to be used for at least one of the bucket and the boom; and select said another position, if it was determined that another position than indicated by the selected control profile is to be used for at least one of the bucket and the boom.

Some advantageous embodiments are defined in the dependent claims. It is to be appreciated that various features in the dependent method claims may be applied by the apparatus, the work machine and/or the computer program product.

These and other aspects of the invention and the embodiments related thereto will become apparent in view of the detailed disclosure of the embodiments further below.

LIST OF DRAWINGS

In the following, various embodiments of the invention will be described in more detail with reference to the appended drawings, in which FIG. 1 shows a schematic representation of a loading apparatus as an example of a work machine suitable for implementing the embodiments of the invention;

Figure 7A:
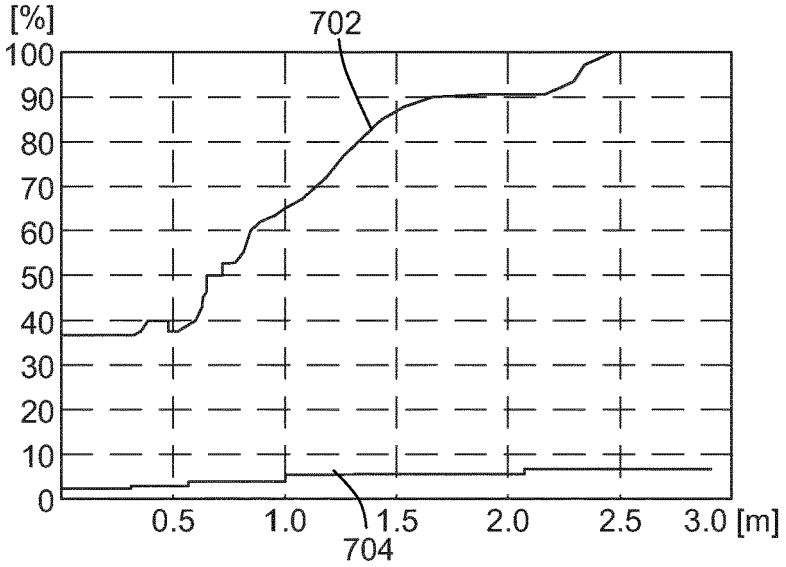
Figure 7B:
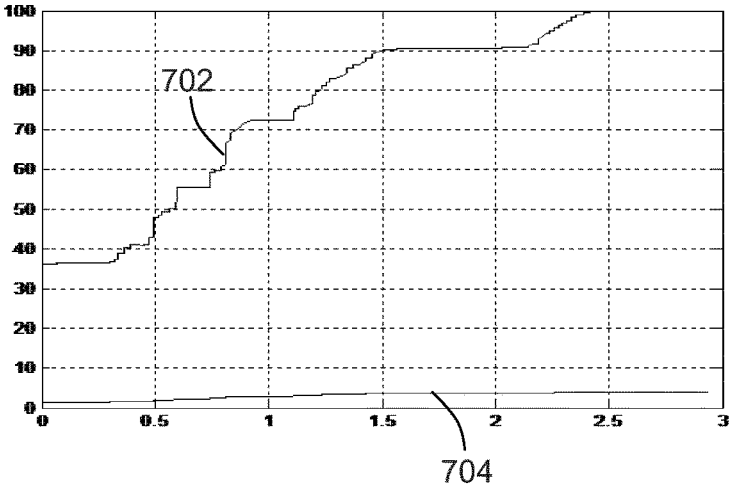
Figure 8:
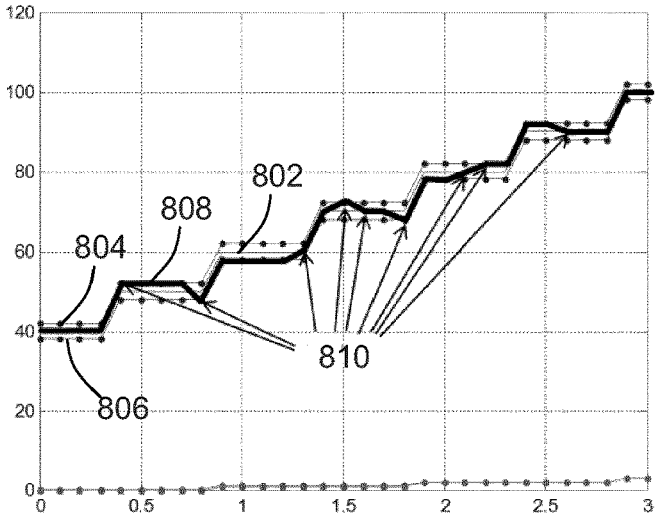
Figure 9:
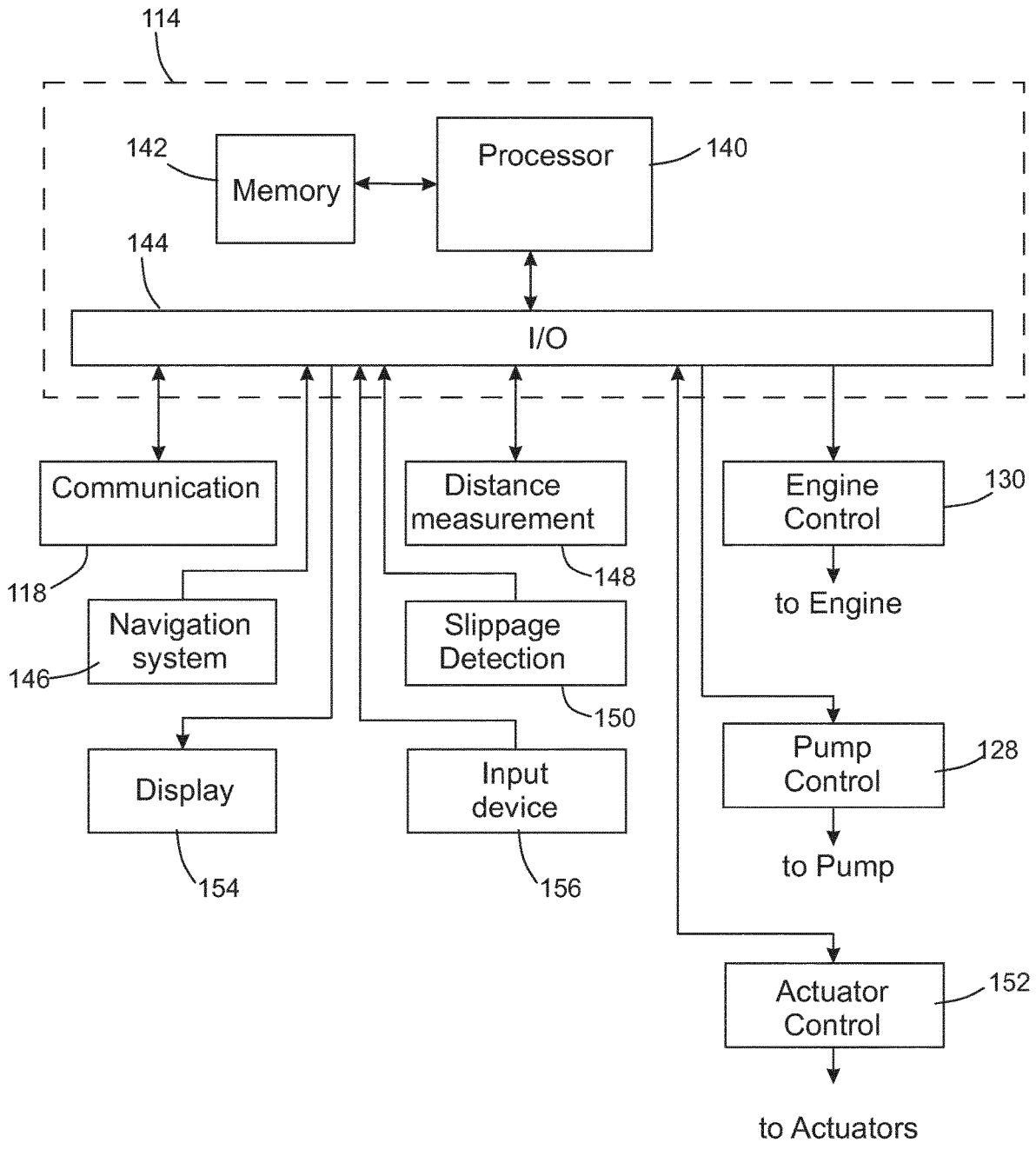

FIGS. 7*a* and 7*b* illustrate examples of basic control profiles;

FIG. 8 illustrates an example of changes of the control profile during operation of the work machine; and FIG. 9 shows a schematic diagram of a control unit according to an example embodiment of the invention.

DESCRIPTION OF SOME EMBODIMENTS

The presently disclosed embodiments are applicable, in particular, to various remotely operable work machines used in mining industry, construction sites etc. suitable for loading, transporting and unloading excavated material or other bulk material. Particular examples of such work machines are loading equipment comprising a bucket attached with a boom. The excavated material may, for example, be rocks excavated in a surface or underground operating area. In this context, the term "rock" is to be understood broadly to cover also a boulder, rock material, crust and other relatively hard material.

Figure 1:
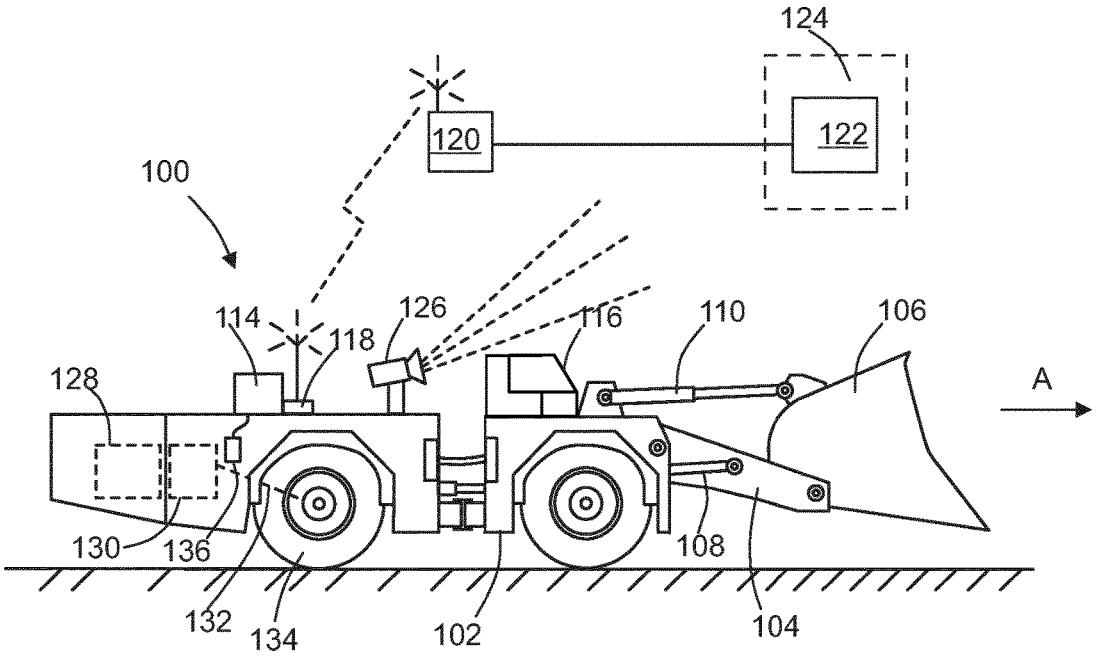

FIG. 1 shows an example of a work machine 100 comprising a movable carrier 102, one or more booms 104 and a bucket 106 attached in a pivotable or otherwise movable manner to the one or more booms 104. For example, the bucket 106 may be coupled to two booms 104 of the work machine. The attachment may comprise a pivot wherein the bucket 106 may be turned with respect to the pivot. The work machine 100 further comprises a first actuator 108 for moving the boom 104 upwards and downwards, and a second actuator 110 for turning the bucket 106 as will be described later in this specification. The actuators 108, 110 may be hydraulically and/or electrically operable actuators or operable by some other source of energy. It should also be noted here that the first actuator 108 and/or the second actuator 110 may in practise comprise more than one actuator. The rock drilling apparatus typically comprises a plurality of pumps 128 for generating hydraulic pressure for operating various parts of the apparatus, such as moving the work machine 100, lifting the boom 104, turning the bucket 106 etc. Instead or in addition to the hydraulic pumps the work machine 100 may comprise one or more other sources of energy, such as an accumulator, a hydrogen container, a fuel tank, etc.

The work machine 100 may comprise an engine 130, which may be driven by the hydraulic pump 128 or it may be e.g. a combustion engine or an electric engine. Power from the engine 130 may be provided by a crank shaft 132 to the wheels 134 either directly or via a gear box (not shown).

The work machine 100 further comprises at least one control unit 114 arranged to control actuators of the work machine 100, the actuators being arranged in a first control system. The control unit 114 may be a computer or a corresponding device, and it may comprise a user interface with a display device as well as control means for giving commands and information to the control unit 114. The control unit 114 and its user interface may be located within a cabin 116 of the rock drilling apparatus 100.

Further, the loading apparatus 100 may have a data transfer unit 118, with which the control unit 114 may establish a data transmission connection to a second control system 122 external to the loading apparatus 100 by utilising a wireless connection provided by a base station 120. The second control system may reside at a control station 124 that may be arranged outside the mine. The control systems may be computers equipped with appropriate software. A remote operator may monitor and control the operations of the loading apparatus 100 via the wireless connection.

FIG. 9 shows a schematic diagram of an example embodiment of the control unit 114. The control unit 114 may comprise a processor 140 for executing computer code, memory 142 for storing computer code, data etc., an interface 144 to communicate with peripherals of the control unit such as a navigation system 146, a distance measuring unit 148, a slippage detection system 150, output units 152 for controlling the actuators 108, 110, the hydraulic pump(s) 128, the engine 130, etc., a display 154 for displaying information, an input device 156 for receiving instructions, the data transfer unit 118 etc.

FIGS. 1 and 9 are simplified figures, and the control system of a mining vehicle, such as the loading apparatus 100, may comprise several units for implementing different control functions. The control system of the mining vehicle may be a distributed entity consisting of modules connected to a CAN (Controller Area Network) bus, for example, and managing all measurements and controls of the machine. The information system of the control station 124 may also comprise one or more servers, databases, operator workstations and a connection to other networks and systems.

The work machine 100 of FIG. 1 and the control unit 114 of FIG. 9 are disclosed herein only as an example of a vehicle and the control unit where the embodiments disclosed herein may be implemented. The embodiments are equally applicable to any other loading vehicles and control units.

In an embodiment the control unit 114 obtains information regarding the distance traveled by the work machine 100 from a source external to the work machine 100. For example, a mine may be provided by distance measuring units, proximity sensors, etc. which may send information on the location of the work machine 100 to the control unit 114 wherein the control unit 114 may use this information to determine the distance traveled by the work machine 100, or the source may provide this information to the control unit 114.

In an embodiment the control unit 114 may be external to the work machine 100, wherein the work machine 100 may or may not be without such control unit 114.

The control system of the mining vehicle may comprise a positioning system or unit. Various methods may be used for determining the location of the mining vehicle, for example, depending on whether the mining vehicle is used in surface drilling or in underground drilling. In surface drilling, it may be possible to use satellite navigation, such as the GPS system, for determining the location and orientation of the mining vehicle with sufficient accuracy.

In underground drilling, the location of the mining vehicle may be determined using e.g. a tachymetry process. A sufficient number of navigation points with predetermined locations, for example in a tunnel to be excavated, are used for linking a tachymeter to the xyz coordinate system to be used. The mining vehicle is provided with targets, the locations of which in relation to the origin of the coordinate system of the mining vehicle have been determined. The tachymeter is used for continuously measuring the xyz coordinates of the targets. Moreover, at least one point of a stack of material may be determined in a level of navigation. On the basis of these data, possibly together with a curvature table and the inclination of the mining vehicle, the mining vehicle may determine its location and the location and the orientation of the stack of material.

Another possible method for determining the location of the mining vehicle is based on dead reckoning in which a current location may be estimated by using a previous determined position and information on the distance and direction the mining vehicle has moved from the previous determined position. The direction of movement may be obtained by using e.g. a gyroscope and the distance may be obtained e.g. from an odometer or information provided by a laser scanner. Errors which may occur during the use of the dead reckoning method may be corrected e.g. by utilizing environment models and wall profiles of the underground drilling site.

Furthermore, regardless of whether a satellite navigation, a tachymetry process or another appropriate method is used for determining the location of the mining vehicle, the mining vehicle and its sub-units, such as the work machine 100 having its bucket 106 and boom 104, may be provided with sufficient number of sensors, such as gyroscopes, compass sensors, inclinometers, rotary encoders, linear encoders and accelerometers, for ensuring sufficient positioning accuracy for the bucket loading and driving processes. As a result, when the mining vehicle navigated with sufficient accuracy carries out a bucket loading process, accurate enough locations may be obtained for the work machine 100, the bucket 106 and the boom 104.

Thus, the operations of the mining vehicle may be remotely controlled and monitored, as well as be automated to be carried out at least partly autonomously.

Figure 2:
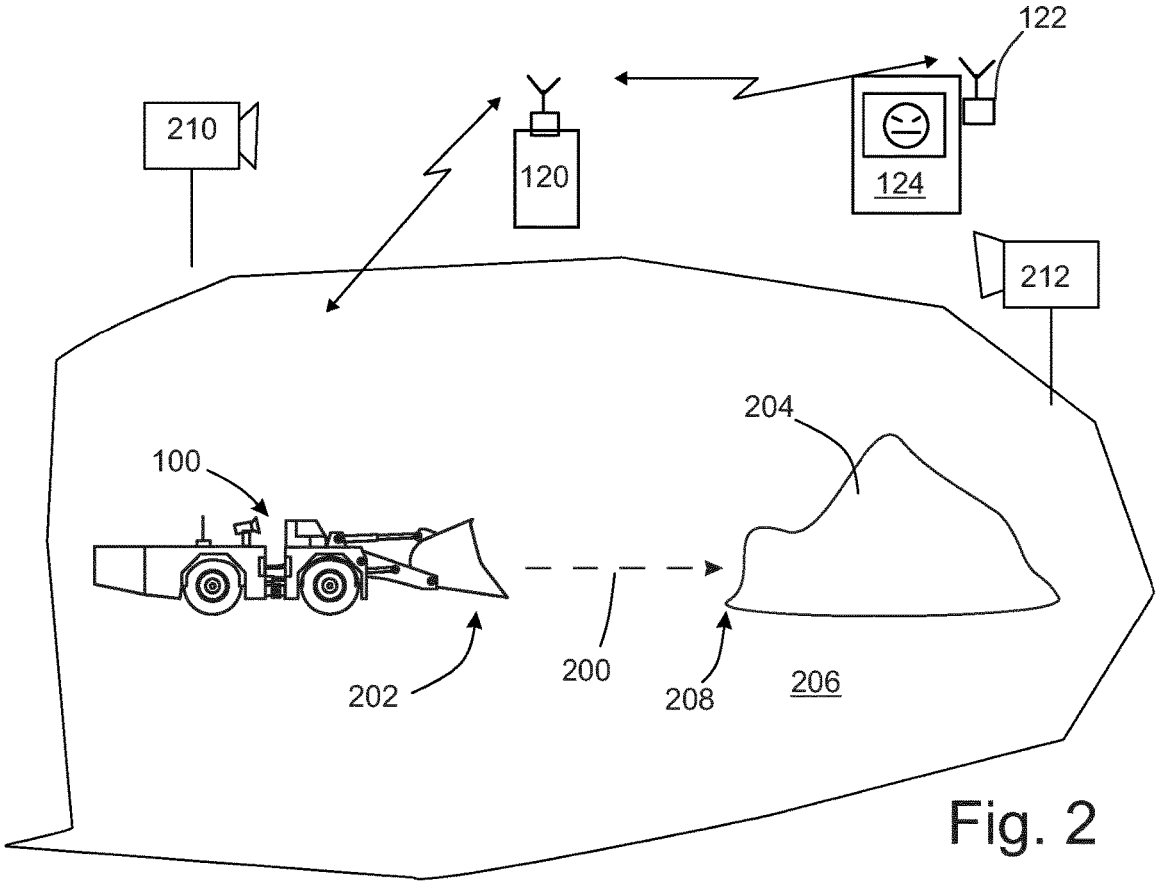
FIG. 2 illustrates an example of a route the work machine moves from a starting point to arrive at the stack of material.

FIG. 2 illustrates the principle of operating the work machine 100 for loading the bucket 106. Herein, the work machine 100 may be monitored and controlled from a remote control station 124 locating outside the operating area 206. In underground mines, the remote control station may be located, for example, on the ground surface or a location remote from the mine, whereupon a plurality of cameras 210, 212 may be provided in the operating area for monitoring the operations. Also the work machine 100 may be provided with one or more cameras. The views captured by the cameras are transmitted to the remote control station. In surface mining, the remote control station may be provided, for example, in a vehicle, such as a van, where the control station comprises computers equipped with necessary user interfaces, such as one or more displays and appropriate software.

A wireless data connection is established between the remote control station 124 and the work machine 100. The work machine 100 may send intermittently various sensor data and video describing the operations of the work machine 100 to the control station via the wireless connection. A remote operator may monitor and control the operations of the work machine 100.

Some terminology will now be shortly described. A control profile contains information on a desired position of the bucket 106 and/or the boom 104 of the work machine 100 as a function of distance with reference to a reference location. There may be one or more control profiles common for both the bucket 106 and the boom 104, or there may be separate control profiles, which may thus be called as a bucket control profile and a boom control profile, respectively. A set of control profiles includes several control profiles, wherein one of the control profiles in the set may also be called as a basic (or default or main) control profile. Control profiles which define a higher position for the bucket or boom than the basic control profile at the same distance from the reference location may be called as control profiles above the basic control profile, and, respectively, control profiles which define the position of the bucket or boom lower than the basic control profile may be called as control profiles below the basic control profile. A bucket control profile which indicates higher position for the bucket than another bucket control profile may also be called as a higher bucket control profile in this application. Respectively, a bucket control profile which indicates lower position for the bucket than another bucket control profile may also be called as a lower bucket control profile. Correspondingly, a boom control profile which indicates higher position for the boom than another boom control profile may also be called as a higher boom control profile in this application, and a boom control profile which indicates lower position for the boom than another boom control profile may also be called as a lower boom control profile.

FIG. 2 illustrates an example of a route 200 the work machine 100 may move from a starting point 202 to arrive at the stack of material 204. The reference numeral 208 depicts the location where the loading shall be started and which is used as the reference location.

Figure 4:
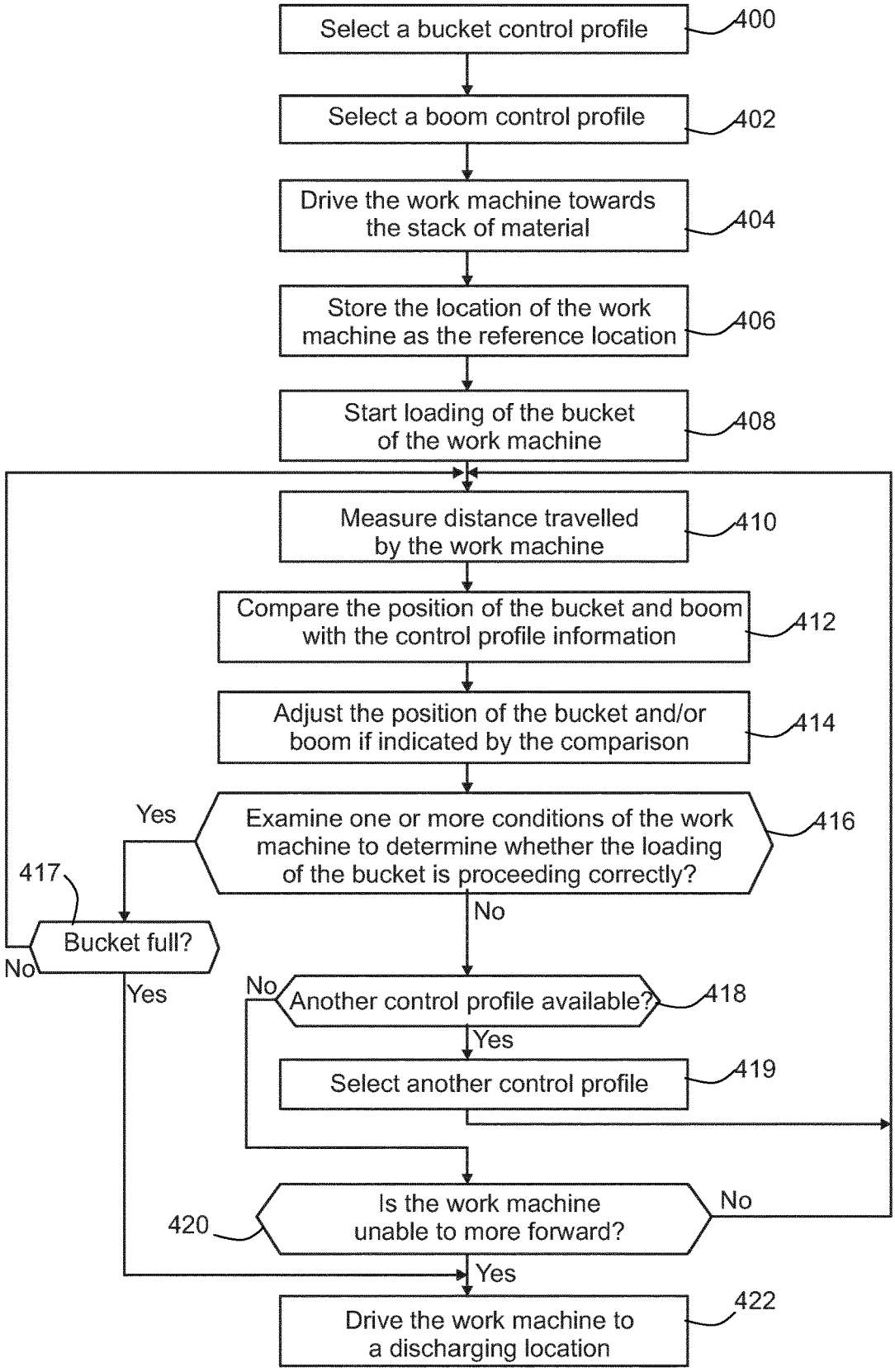
FIG. 4 shows a flow diagram of a method according to a first embodiment of the invention.

Now according to an aspect of the invention, FIG. 4 illustrates an example of a method for loading the bucket. In this example there is a set of bucket control profiles and a set of boom control profiles. All the bucket control profiles in the set of bucket control profiles may have substantially similar form with each other or they may be different in the form, and they indicate bucket positions which are at a distance from corresponding bucket positions indicated by the other bucket control profile. Correspondingly, all the boom control profiles in the set of boom control profiles may have substantially similar form with each other or they may be different in the form, and they indicate boom positions which are at a distance from corresponding boom positions indicated by the other boom control profile. Furthermore, the values of the control profiles may be limited within extreme limits of movements of the bucket and the boom. In other words, the bucket control profile does not include values which exceed the limits of movement of the bucket, and the boom control profile does not include values which exceed the limits of movement of the boom.

It is possible to have location-specific control profiles. It may further be possible to define extreme limits of movements of the bucket and the boom on the basis of the environment in which the work machine 100 will be operated or is operating. For example, situations may occur in which a roof of a tunnel or a mine may define the highest point the bucket 106 and the boom 104 are allowed to rise. In other words, it may be preferable that the bucket 106 and the boom 104 will not touch the roof. The height of the environment (e.g. a tunnel or mine) may vary wherein the extreme limits may also vary in different locations of the environment.

In an embodiment of the method one bucket control profile is selected 400 from the set of bucket control profiles and one boom control profile is selected 402 from the set of boom control profiles. The selection of the control profile(s) may be based on some parameters regarding the work machine 100, properties of the material to be loaded, the environment where the work machine 100 is operating, etc. As a non-limiting example different kinds of control profiles may have been prepared for different kinds of materials and/or different sizes of stacks of materials and/or for different kinds of mines, excavation sites, constructions sites, etc.

The work machine 100 may not initially be located beside the stack of material to be loaded wherein the work machine 100 is driven 404 alongside the stack of material. This may be performed e.g. by the control unit 114 which may utilize information on the environment of the work machine 100, information on the location of the stack of material 204 and information on the position of the work machine 100. Alternatively or in addition to, information on a route to the stack of material 204 may have been provided (stored) to the control unit 114 so that it may control the movement of the work machine 100 to follow the route.

Once the work machine 100 has arrived near the stack of material the location of the work machine 100 may be stored 406 to the memory as the reference location 208. In other words, in this example the reference location 208 is the location of the work machine 100 when it is in front of the stack of material. It should be noted that the reference location need not be represented as an absolute location of the work machine 100 but also another way to express the location may be used to enable the control unit to determine how far the work machine 100 has moved from the reference location during loading.

The control unit may instruct the work machine 100 to start loading 408. This means that the power transmission of the work machine 100 is started and the wheels or other elements for moving the work machine 100 tries to move the work machine 100 towards the stack of material 204, wherein the bucket 106 starts to collect material from the stack of material 204. During loading distance traveled by the work machine 100 is measured 410. At some intervals the current position of the bucket and boom is compared 412 with the position indication provided by the bucket control profile and, respectively, the boom control profile at the measured distance from the reference location. This information may then be used to determine whether to adjust 414 the position of the bucket and/or the boom to comply with the position indicated by the selected bucket control profile/boom control profile. The control unit also examines 416 one or more conditions regarding the work machine during loading. If any of the examined conditions reveal that the loading does not proceed as it should be, the control unit may examine 418, if another control profile is available, and if so, decide to select 419 another control profile for the bucket and/or the boom and continue the operation e.g. from the step 410. The decision which control profile to use depend on inter alia the examined condition. In the following, some non-limiting examples of the conditions will be described.

If the examination in step 418 reveals that no more control profiles are available, the control unit may examine 420 is the work machine is unable to move forward. If so, the control unit may instruct 422 the work machine to drive to a discharging location.

On the other hand, if it is determined in step 416 that the loading seems to proceed as it should be, the control unit may examine 417, if the bucket is already full and if so, the control unit may instruct 422 the work machine to drive to a discharging location. Otherwise, the control unit may continue the loading of the bucket e.g. by repeating the operations from the step 410.

The control unit 114 or some other entity may receive information from one or more speed sensors to measure the speed of the work machine. In addition to or instead of the speed sensors 136 the speed of the work machine may be measured on the basis of location data of the work machine 100. For example, the work machine 100 may comprise one or more scanners 126, such as laser scanners, which may provide information suitable to be used in the speed measurement. Another example of suitable equipment is positioning apparatus such as a GPS receiver (Global Positioning System) and a tachymeter. If the measured speed indicates that the work machine 100 has stopped moving, another bucket control profile may be selected so that the bucket 106 will be moved upwards (i.e. a higher bucket control profile may be selected). If the work machine 100 is still not moving, a still higher bucket control profile may be selected until the work machine starts to move again or until any higher bucket control profiles do not exist or the bucket 106 has reached its highest allowable position. If any higher bucket control profiles do not exist or the bucket 106 has reached its highest allowable position the loading may be stopped or another boom control profile may be tried to solve the situation.

It may also happen that the work machine 100 does not totally stop but the speed of the work machine 100 becomes too slow i.e. falls below a first speed threshold. If so, another bucket control profile may be selected so that the bucket will be moved upwards (i.e. a higher bucket control profile may be selected). If the work machine 100 still moves too slowly, a still higher bucket control profile may be selected until the speed of the work machine rises above the first speed threshold.

On the other hand, if the measured speed indicates that the speed of the work machine 100 becomes too high i.e. exceeds a second speed threshold, another bucket control profile may be selected so that the bucket will be moved downwards (i.e. a lower bucket control profile may be selected). If the work machine 100 still moves too fast, a still lower bucket control profile may be selected until the speed of the work machine falls below the second speed threshold.

The control unit 114 may receive information of rotation speed of the wheels of the work machine 100. If this information reveals that there is a difference in the rotation speed of two or more wheels of the work machine 100, the control unit 114 may determine that at least one wheel slips which may mean that the force induced by the stack of material to the work machine 100 is too high. Hence, the control unit may change this situation by selecting a higher position for the bucket 106. In this example, a higher bucket control profile may be selected.

Slippage of the wheels may also occur in such a way that the rotation speed of each wheel is almost the same but the speed of the work machine 100 is zero or almost zero. Also in this case a higher bucket control profile may be selected.

The control unit 114 may also receive information on the position of the bucket 106. Hence, the control unit 114 may, after instructing bucket movement actuators to move the bucket 106 to a higher position indicated by the bucket control profile, examine whether the bucket has reached the higher position. If the examination reveals that the bucket was unable to move to the higher position, the control unit 114 may try to resolve this by selecting a lower boom control profile to move the boom downwards. If the bucket is still not able to reach the higher position, the loading may be stopped or the boom may be moved to a still lower position.

As mentioned above, loading of the bucket 106 may be stopped when the bucket becomes full or when the change of bucket control profile and/or boom control profile does not enable the work machine 100 to move any further. Then the work machine 100 may be driven 422 to a discharging location to empty the bucket 106 and a new loading operation may be initiated, if needed.

It should be noted here that the examination whether the bucket is full or not need not take place at the location indicated in FIG. 4 but it may also be performed at another stage. It may also be possible that the control unit may examine the fullness of the bucket at several different stages during the loading process.

In an embodiment, when the control unit has determined that the loading should be stopped e.g. because the bucket 106 is full or the work machine 100 was unable to continue the loading operation, it may be possible to weigh the work machine 100 to determine the weight of the material loaded to the bucket 106. This information may then be used to decide whether to try to continue the loading operation or to drive the work machine 100 to the discharging location for discharging the bucket 106 or to call an operator to e.g. begin manual operation of the work machine 100 or to perform some other acts to solve a possible problem in the automatic loading.

Figure 5:
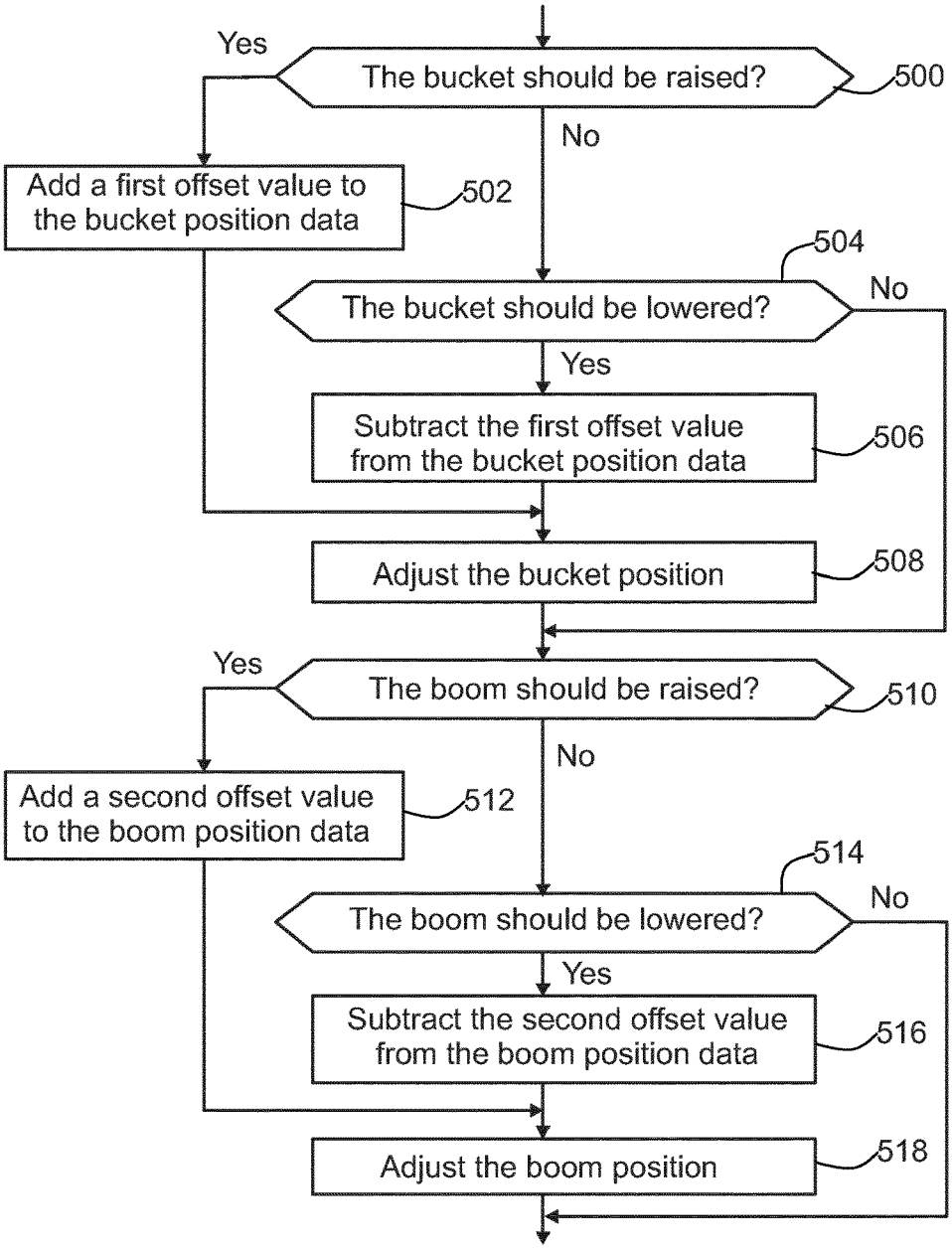
FIG. 5 shows a flow diagram of a method according to a second embodiment of the invention.

In another example embodiment the set of different bucket control profiles and the set of different boom control profiles are not needed but only one bucket control profile and one boom control profile may be sufficient, wherein if it is determined that the position of the bucket and/or the boom need to be changed in a different manner than what is indicated by the control profile, one or more offset values may be used instead of higher and lower control profiles, as will be explained next with reference to FIG. 5.

If it is determined 500 that the bucket 106 needs to be raised to a higher position, a first offset value may be added 502 to the bucket position data indicated by the control profile and the position of the bucket 106 is adjusted 508 accordingly. On the other hand, if it is determined 504 that the bucket 106 needs to be lowered to a lower position, the first offset value may be subtracted 506 from the bucket position data indicated by the control profile and the position of the bucket 106 is adjusted 508 accordingly. Similarly, if it is determined that the boom 104 needs to be raised 510 to a higher position or lowered 512 to a lower position, a second offset value may be added 514 to or subtracted 516 from the boom position data indicated by the control profile and the position of the boom 104 is adjusted 518 accordingly. Hence, only one control profile may be needed in this embodiment.

It should be noted here that different offset values may be used in different steps. For example, when the bucket 106 is to be raised higher than the control profile indicates, one offset value may be used, and when the bucket 106 is to be lowered lower than the control profile indicates, another offset value may be used instead.

When the position of the bucket 106 or the boom 104 is adjusted further away from the position defined by the control profile, the increment/decrement may be constant at each change i.e. the offset value is added N times, in which N is an integer value greater than one, or the increment/decrement may not be the same. For example, the first increment/decrement may be equal to the offset value but the following increments/decrements may be smaller or larger than the offset value. To clarify this, the operation will be described more detail in the following.

Let us assume that the bucket 106 and boom 104 are following the basic control profile i.e. they are positioned according to the positions indicated by the basic control profile as the work machine 100 moves forward towards the stack of material 204. If, at some state, it is determined that the loading may not be continued by following the basic control profile, the position of the bucket 106 and/or the boom 104 may be adjusted by adding/subtracting the offset value to/from the control profile value. If this change does not enable continuing the loading, the position of the bucket 106 and/or the boom 104 may still be adjusted by adding/subtracting the offset value twice to/from the control profile value, or by adding/subtracting the offset value multiplied by a factor K (K>1) to/from the control profile value. It should be noted that the offset value and the multiplication factor K need not be the same for the adjustment of the bucket 106 and the boom 104.

The control unit 114 may receive feedback from the actuators (or from sensors indicating position data of the bucket/boom), when instructing the actuator(s) to move the bucket 106 and/or the boom 104 to determine whether the bucket 106 and/or the boom 104 have reached their target position(s). Hence, the control unit 114 may also use this information to determine if the bucket 106 or the boom 104 is not able to reach the target position. The movements of the bucket 106 and the boom 104 require some time. Therefore, to avoid false indications, it may be necessary to define a time delay between sending an instruction to an actuator to change the position of the bucket 106 or the boom 104 and obtaining the actual position of the bucket 106 or the boom 104, respectively.

It may happen that there is a relatively large step (a change in the position of the bucket/boom) in the control profile. Therefore, the bucket 106 or the boom 104 may not be able to change its position very fast wherein the control unit 114 may erroneously deduce that the bucket/boom has stuck and a corrective operation may be needed. In this kind of situation the large step may be divided into smaller steps e.g. by interpolating, and/or the above mentioned time delay may be increased.

Figure 6:
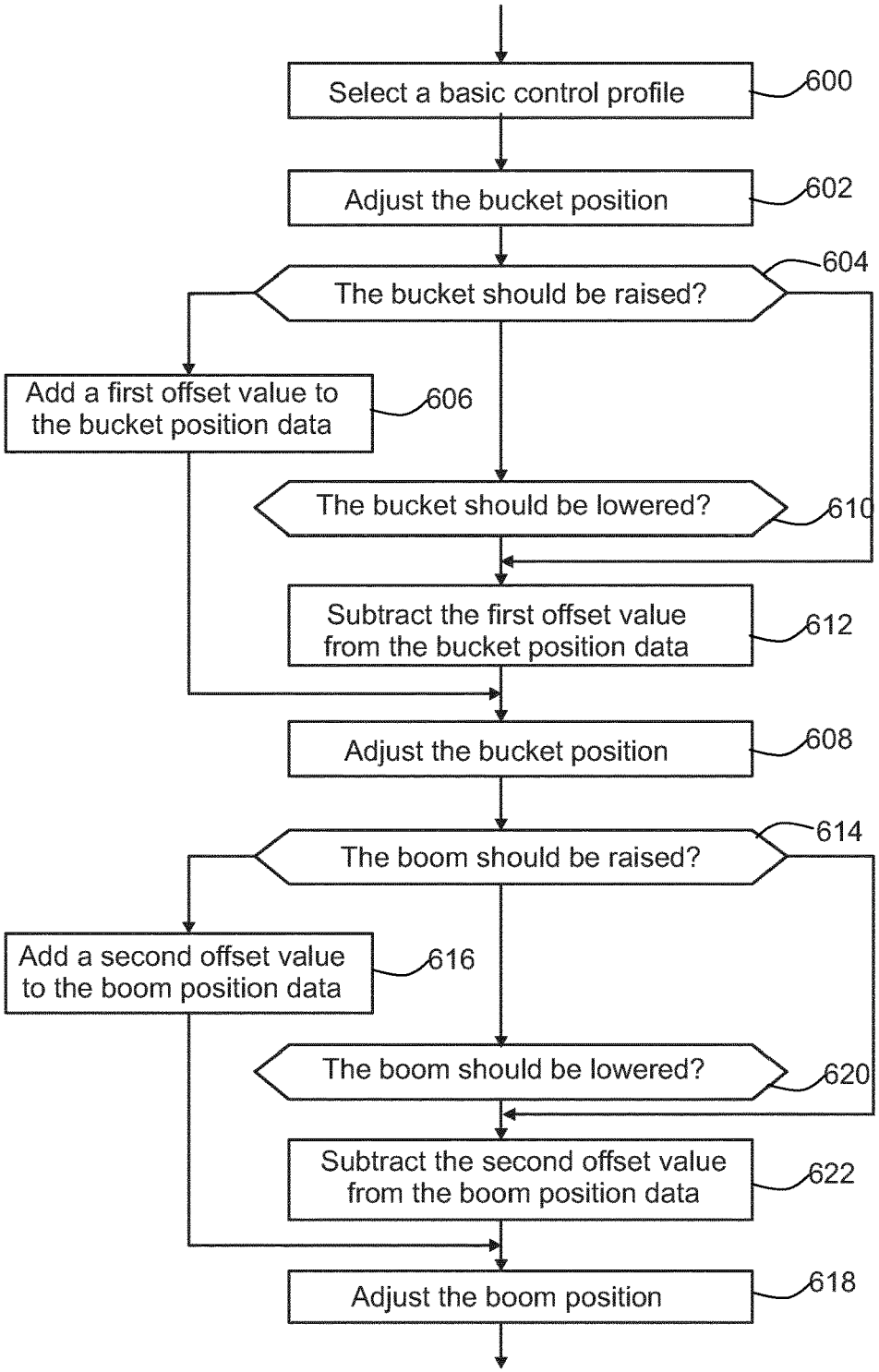
FIG. 6 shows a flow diagram of a method according to a third embodiment of the invention.

In the following, still another embodiment will be illustrated with reference to FIG. 6. In this case the same control profile may be used for the bucket and the boom instead of separate control profiles. In this case the control profiles include position data for both the bucket and the boom with reference to a reference location. Initially, when the loading begins, a basic control profile is selected 600. During loading the position of the bucket and the boom is adjusted 602 accordingly, until it is determined that the position of the bucket and/or the boom need to be changed in a different manner than what is indicated by the control profile. In such a case, if it is determined 604 that the bucket needs to be raised to a higher position, a first offset value may be added 606 to the bucket position data indicated by the control profile and the position of the bucket is adjusted 608 accordingly. On the other hand, if it is determined 610 that the bucket needs to be lowered to a lower position, the first offset value may be subtracted 612 from the bucket position data indicated by the control profile and the position of the bucket is adjusted 608 accordingly. Similarly, if it is determined that the boom needs to be raised 614 to a higher position or lowered 620 to a lower position, a second offset value may be added 616 to or subtracted 620 from the bucket position data indicated by the control profile and the position of the boom is adjusted 618 accordingly. Hence, only one control profile may be needed in this embodiment.

The bucket and boom position data may be expressed in the control profile(s) as a percentage of the extreme position, for example. However, it should be noted that the bucket and boom control data may be defined in many different ways.

Figure 3:
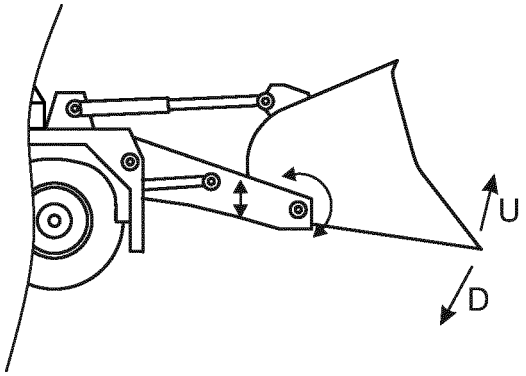
FIG. 3 shows a schematic representation of directions of movements of a bucket and a boom of a work machine according to an embodiment of the invention.

In the above examples the position of the bucket was indicated as a rotating angle with respect to a reference position. The reference position may be the position in which the bucket is positioned at the start of loading the bucket. For example, the reference position may be zero degrees i.e. the bottom of the bucket is in a horizontal direction. Increasing the position of the bucket may mean that the bucket is rotated in such a way that the front edge of the bucket moves upwards (illustrated with the arrow U in FIG. 3), and decreasing the position of the bucket may mean that the bucket is rotated in such a way that the front edge of the bucket moves downwards (illustrated with the arrow D in FIG. 3). The work machine may try to keep the alignment of the bucket 106 the same with respect to the ground, when the boom is raised or lowered. Hence, changing the position of the boom 104 may also cause a change in the angular position of the bucket 106 with respect to the boom 104.

In FIGS. 7*a* and 7*b*, which illustrate some examples of control profiles, x coordinate represents the distance from the reference location (x=0) and y coordinate represents the relative position of the bucket/boom in such a manner that the value 0% means the lowest possible position and the value 100% means the highest possible value of the bucket/boom. In FIGS. 7*a* and 7*b* the reference numeral 702 indicates the bucket control profile and the reference numeral 704 indicates the boom control profile.

FIG. 8 illustrates an example of changes of the bucket control profile during operation of the work machine. The selected basic bucket control profile is illustrated with the line 802, the bucket control profile above the basic bucket control profile is illustrated with the line 804, and the bucket control profile below the basic bucket control profile is illustrated with the line 806. The line 808 illustrates the selected bucket control profile at different time instants during loading. Arrows 810 indicate locations in which the bucket control profile has been changed. It can be seen that the loading is started with the basic bucket control profile. At the distance 0.4 m the bucket control profile above the basic bucket control profile has been taken into use. At the distance 0.8 m the bucket control profile below the basic bucket control profile has been taken into use. At the distance 1.3 m the basic bucket control profile has again been taken into use.

In addition to bucket positions and boom positions some other parameters may be controlled by a control profile. For example, in an embodiment the power of the engine 130 and/or the air pressure of the wheels 134 of the work machine 100 may be controlled in order to improve the loading efficiency. As an example, if it is detected that the work machine 100 is about to stop, the engine 130 may be controlled to increase the power and if the work machine 100 does not start to move, then the position of the bucket 106 and/or the boom 104 may be changed. On the other hand, if it is detected that one or more of the wheels 134 begin to slip, the engine 130 may be controlled to decrease the power or the pressure of the wheels 134 may be changed, and if the wheel(s) 134 still slip, then the position of the bucket 106 and/or the boom 104 may be changed.

In the following an example embodiment of forming a control profile to be used as the basic control profile and a boom control profile is described in more detail. In this embodiment separate control profiles are formed for the bucket and the boom, i.e. a bucket control profile and a boom control profile are formed. The control profiles are formed by performing a teaching drive with the work machine 100 wherein the control apparatus may be used to receive information from the operator who is performing the learning process and sensors of the work machine to determine inter alia the position of the bucket 106, the boom 104 and the location of the work machine 100 at different time instants during the learning process. The operator initiates the learning process by driving the work machine 100 adjacent to the stack of material, wherein the operator informs the control apparatus that the work machine is now at the reference location. Hence, the control apparatus may determine the current location and store it as the reference location. Furthermore, the operator moves the bucket 106 and the boom 104 to a desired position for starting the learning process. This position need not be the lowest position of the bucket 106 and/or the boom 104 but may also be another position which the operator finds appropriate e.g. on the basis of her/his previous experiences on loading processes with such work machine 100. Next, the operator starts to move the work machine 100 and adjusted the position of the bucket 106 and the boom 104, if necessary. The control apparatus receives information on the location of the work machine and information on changes of the positions of the bucket 106 and the boom 104. Hence, the control apparatus may form control profiles by storing position values and corresponding location values (with reference to the reference location). The values may be stored e.g. at fixed distance intervals i.e. a new value regarding the position of the bucket/boom is stored each time the work machine has moved forward a certain amount, or a new value may be stored when the position of the bucket/boom has changed more than a certain threshold. These values may be stored as a table of x,y values or as another appropriate indication. This process of storing values may be repeated e.g. until the work machine 100 has moved long enough to fill the bucket 106, or until the operator has other reasons to end the learning process, e.g. the work machine 100 has reached the other end of the stack or material. The stored values represent the bucket control profile and the boom control profile. Hence, skills of a very experienced operator may be utilized at a set of work machines at one or more sites, or operators may set their own personal profiles for work machines they are supervising.

The above described "teaching by learning" process may be repeated and e.g. an average of control profiles of different teaching drives may be calculated wherein the average values may be used to define the control profiles.

It may also be possible to repeat the above described "teaching by learning" process by using different kinds of materials, wherein e.g. an average of control profiles of different teaching drives with different kinds of material may represent the control profile, or a separate basic control profile may be formed for each kind of material used during the teaching drives.

In another example the basic control profile(s) may be formed by programming with a computer. The operator may use e.g. a graphical user interface and appropriate software with which s/he may draw curves illustrating the control profiles on a display and the software translates the drawn curves into control profiles to be stored into the memory 142 of the control apparatus of the work machine 100.

In the embodiments in which one or more sets of control profiles has been formed, each control profile of the set may be formed on the basis of the basic control profile. For example, control profiles above the basic control profile may be formed by adding a certain value or a multiple of the value to the values of the basic control profile, and control profiles below the basic control profile may be formed by subtracting a certain value or a multiple of the value to the values of the basic control profile. However, also other kinds of principles may be implemented in forming the sets of control profiles.

It may also be possible to construct many basic control profiles for different kinds of materials. For example, one basic control profile may be formed for ore, another basic control profile may be formed for break stone, still another basic control profile may be formed for sand, etc. Hence, the operator of the work machine 100 may select the basic control profile among several control profiles which corresponds with the material to be loaded.

In an embodiment, if the operator of the work machine detects that the selected basic control profile does not suit properly for loading the material, the operator may be able to select another control profile to be used as the basic control profile during loading.

In an embodiment feedback on the effectiveness of control profiles may be obtained during use. For example, an operator of a work machine may notice which control profile is the most suitable for a certain kind of material, wherein that control profile may be defined to represent a preferable basic control profile for that material. As another example, feedback on the effectiveness of control profiles during use may be obtained cumulatively from different use situations, wherein it may be possible to deduce which control profile has been detected to suit best for loading of a certain kind of material.

In an embodiment feedback may be obtained on the basis of real use situations so that the control profiles may be adapted to better suit them for certain kind of material. An operator of a work machine may notice that the control profile which has been selected does not work properly, wherein the operator may adjust some parts of the control profile. Information on the adjustments of the control profile may then be submitted to a location where control profiles have been stored, e.g. to a control room, and the control profile may be adjusted accordingly.

In an embodiment the control profile(s) may be configurable e.g. in such a way that more conditions/parameters could be added to existing ones and/or that it may be possible to select which conditions/parameters shall be taken into account when the control profile is in use. In this way the control profile(s) may be adapted to different kinds or loading sites and events during loading.

The display 154 may be used to show the control profile to the operator of the work machine 100. Hence, the operator may e.g. detect that a certain kind of movement is needed at a certain location wherein that information may be used for adjusting the control profile accordingly, if needed. As another example, the operator may use the input device(s) 156 to adjust the control profile shown on the display 154 if he notices that some changes might be needed to the control profile.

A skilled person appreciates that any of the embodiments described above may be implemented as a combination with one or more of the other embodiments, unless there is explicitly or implicitly stated that certain embodiments are only alternatives to each other.

The various embodiments of the invention can be implemented with the help of computer program code that resides in a memory and causes the relevant apparatuses to carry out the invention. For example, a work machine may comprise circuitry and electronics for handling, receiving and transmitting data, computer program code in a memory, and a processor that, when running the computer program code, causes the machine to carry out the features of an embodiment.

The various embodiments of the invention may be implemented as co-functional modules in the work machine, the modules being preferably replaceable as such. The modules may be implemented as hardware, software or a combination of them. Some of the operational elements may, instead or in addition to the work machine 100, be located outside the work machine 100, for example in a computer of a control station 124.

It is obvious that the present invention is not limited solely to the above-presented embodiments, but it can be modified within the scope of the appended claims.

The invention claimed is:

1. A method for controlling loading material to a bucket of a work machine from a stack of material, the method comprising:

a) selecting a bucket control profile from a set of bucket control profiles to be used as a basic bucket control profile including indications for positions of the bucket of the work machine as a function of a distance travelled by the work machine with reference to a reference location;

b) selecting a boom control profile from a set of boom control profiles to be used as a basic boom control profile including indications for positions of a boom of the work machine as a function of the distance travelled by the work machine with reference to the reference location;

c) obtaining information of a distance travelled by the work machine with reference to the reference location while loading material to the bucket;

d) comparing, at intervals of the distance travelled by the work machine, the position of at least one of the bucket and the boom with the position indicated in the selected bucket control profile and the selected boom control profile;

e) examining at least one condition regarding the work machine during loading;

f) determining, on a basis of the comparison and the examined condition, whether another control profile is to be selected for the bucket or the boom or both; and g) if so, selecting another control profile for the bucket or the boom or both.

2. The method according to claim 1, further comprising driving the work machine towards the stack of material before initiating step c) and setting the reference location to correspond with a location of the work machine.

3. The method according to claim 1, wherein the basic bucket control profile and the basic boom control profile are selected on a basis of a type of the material to be loaded.

4. The method according to claim 1, wherein hierarchies are defined for profiles in the set of the bucket control profiles and the set of boom control profiles, wherein one or more control profiles exist at least above or below the basic bucket control profile and the basic boom control profile in the hierarchies, further wherein the method further comprises selecting a control profile, which is a control profile either above or below the basic bucket control profile and the basic boom control profile in the hierarchies.

5. The method according to claim 1, wherein the at least one condition regarding the work machine is at least one of:

a speed of the work machine;

a difference in the speed of two or more wheels of the work machine;

slippage of one or more wheels of the work machine; and the bucket is unable to move to a position indicated by the bucket control profile.

6. The method according to claim 5, further comprising one or more of the following:

stopping the work machine from moving forward, wherein a position of the bucket above the position indicated by the bucket control profile is selected for the bucket until the work machine starts to move forward or until no more bucket positions above a current position of the bucket exists;

slowing the speed of the work machine to below a first threshold, wherein a higher position above the position indicated by the bucket control profile is selected for the bucket;

when at least one wheel slips, a position of the boom above the position indicated by the boom control profile is selected for the boom and a position below the position indicated by the bucket control profile is selected for the bucket;

when the speed of the work machine exceeds a second threshold, a lower position of the bucket below the position indicated by the bucket control profile is selected for the bucket; and when the bucket does not rise to the position indicated by the selected control profile, a position of the boom below the position indicated by the boom control profile is selected for the boom.

7. The method according to claim 1, wherein the basic control profile is formed by performing a teaching drive with the work machine, and storing information on locations of the bucket or the boom or both at different distances to the basic bucket control profile and the basic boom control profile.

8. The method according to claim 1, wherein the basic bucket control profile and the boom control profile are formed by programming steps executed in a computer.

9. The method according to claim 1, wherein at least a part of the bucket control profile and the boom control profile of the set of bucket control profiles and the set of boom control profiles have a form similar to the form of the basic bucket control profile and the basic boom control profile.

10. The method according to claim 9, wherein the set of bucket control profiles and the set of boom control profiles are formed from the basic bucket control profile and the basic boom control profile by adding or subtracting an offset value to or from the values of the basic bucket control profile and the basic boom control profile.

11. The method according to claim 1, wherein bucket control profiles above the basic bucket control profile indicate bucket positions, which are higher than the bucket position indicated by the basic bucket control profile at the distance travelled by the work machine from the reference location, bucket control profiles below the basic bucket control profile indicate bucket positions, which are lower than the bucket position indicated by the basic bucket control profile at the distance travelled by the work machine from the reference location, boom control profiles above the basic boom control profile indicate boom positions, which are higher than the boom position indicated by the basic boom control profile at the distance travelled by the work machine from the reference location, and boom control profiles below the basic boom control profile indicate boom positions, which are lower than the boom position indicated by the basic boom control profile at the distance travelled by the work machine from the reference location.

12. The method according to claim 1, wherein the method comprises in step g) one or more of the following:

the work machine stops moving forward, wherein a bucket control profile above the current bucket control profile is selected until the work machine starts to move forward or until no more bucket control profiles above a current bucket profile and a current boom control profile exists;

the speed of the work machine slows below a first threshold, wherein a bucket control profile above the current bucket control profile is selected;

at least one wheel slips, wherein a boom control profile above the current boom control profile is selected and a bucket control profile below the current bucket control profile is selected;

the speed of the work machine exceeds a second threshold, wherein a bucket control profile below the current bucket control profile is selected; and the bucket does not rise to the position indicated by a selected bucket control profile, wherein a boom control profile below the current boom control profile is selected.

13. The method according to claim 1, wherein the set of bucket control profiles is formed from the basic bucket control profile and the set of boom control profiles is formed from the basic boom control profile.

14. The method according to claim 1, further comprising selecting the basic bucket control profile and the basic boom control profile on the basis of the type of the material in the stack of the material.

15. The method according to claim 1, further comprising determining whether to adjust the position of at least one of the bucket and the boom on the basis of the selected bucket control profile, the selected boom control profile and the distance travelled by the work machine.

16. An apparatus arranged to initiate loading of material to a bucket of a work machine from a stack of material, the apparatus being arranged to:

a) select a bucket control profile from a set of bucket control profiles to be used as a basic bucket control profile including indications for positions of the bucket of the work machine as a function of a distance travelled by the work machine with reference to a reference location;

b) select a boom control profile from a set of boom control profiles to be used as a basic boom control profile including indications for positions of the boom of the work machine as a function of a distance travelled by the work machine with reference to the reference location;

c) obtain information of a distance travelled by the work machine with reference to the reference location while loading material to the bucket;

d) compare, at intervals of the distance travelled by the work machine, the position of at least one of the bucket and the boom with the position indicated in the selected bucket control profile and the selected boom control profile;

e) examine at least one condition regarding the work machine during loading;

f) determine, on a basis of the comparison and the examined condition, whether another control profile is to be selected for the bucket or the boom or both; and g) select said another control profile, if step f) indicated that another control profile is to be selected for the bucket or the boom or both.

17. The apparatus according to claim 16, wherein the apparatus is further arranged to drive the work machine towards the stack of material before initiating step b and set the reference location to correspond with the location of the work machine.

18. The apparatus according to claim 16, wherein the apparatus is arranged to select the basic bucket control profile and the basic boom control profile on a basis of a type of the material to be loaded.

19. The apparatus according to claim 16, wherein hierarchies are defined for profiles in the set of control profiles, wherein one or more control profiles exist at least above or below the basic bucket control profile and the basic boom control profile in the hierarchies, wherein the apparatus is further arranged to select a control profile, which is a control profile either above or below the basic bucket control profile and the basic boom control profile in the hierarchies.

20. A non-transitory memory medium storing thereon a computer program, comprising computer program code for carrying out steps for loading material to a bucket of a work machine from a stack of material, wherein the computer program code, which, when executed by a processor, causes an apparatus to:

a) select a bucket control profile from a set of bucket control profiles to be used as a basic bucket control profile including indications for positions of the bucket of the work machine as a function of a distance travelled by the work machine with reference to a reference location;

b) select a boom control profile from a set of boom control profiles to be used as a basic boom control profile having indications for positions of the bucket of the work machine as a function of a distance travelled by the work machine with reference to the reference location;

c) obtain information of a distance travelled by the work machine with reference to the reference location while loading material to the bucket;

d) compare, at intervals of the distance travelled by the work machine, the position of at least one of the bucket and the boom with the position indicated in the selected profile;

e) examine at least one condition regarding the work machine during loading;

f) determine, on a basis of the comparison and the examined condition, whether another control profile is to be selected for the bucket or the boom or both; and g) select said another control profile, if step f) indicated that another control profile is to be selected for the bucket or the boom or both.

21. A work machine having a bucket attached with a boom for loading material to the bucket from a stack of material, the work machine comprising:

a bucket control profile arranged as a basic bucket control profile including indications for positions of the bucket of the work machine as a function of a distance travelled by the work machine with reference to a reference location;

a boom control profile to be used as a basic boom control profile including indications for positions of the boom of the work machine as a function of a distance travelled by the work machine with reference to the reference location;

equipment for obtaining information of a distance travelled by the work machine with reference to the reference location while loading material to the bucket;

condition monitoring equipment for monitoring at least one condition regarding the work machine; and a control unit arranged to compare, at intervals of the distance travelled by the work machine, the position of at least one of the bucket and the boom with the position indicated in the selected control profile, examine at least one condition regarding the work machine during loading; determine, on the basis of the comparison and the examined condition, whether another control profile is to be selected for the bucket or the boom or both; and select said another control profile, if it was determined that another control profile is to be selected for the bucket or the boom or both.

22. The work machine according to claim 21, wherein the control unit is further arranged to drive the work machine towards the stack of material and to set the reference location to correspond with the location of the work machine.

23. The work machine according to claim 21, wherein the control unit is arranged to select the basic bucket control profile and the basic boom control profile on a basis of a type of the material to be loaded.

* * * * *